US007086448B2

(12) United States Patent
Miyake et al.

(10) Patent No.: US 7,086,448 B2
(45) Date of Patent: Aug. 8, 2006

(54) CASTING AND METHOD OF MAKING SUCH CASTING

(75) Inventors: Takahito Miyake, Kariya (JP); Hiroshi Kobayashi, Kariya (JP); Tomomichi Miura, Kariya (JP); Shuo Uematsu, Kariya (JP)

(73) Assignee: Kabushiki Kaisha Toyota Jidoshokki, Kariya (JP)

( * ) Notice: Subject to any disclaimer, the term of this patent is extended or adjusted under 35 U.S.C. 154(b) by 0 days.

(21) Appl. No.: 11/064,652

(22) Filed: Feb. 23, 2005

(65) Prior Publication Data

US 2005/0183838 A1 Aug. 25, 2005

(30) Foreign Application Priority Data

Feb. 24, 2004 (JP) ..... 2004-047666

(51) Int. Cl.
*B22D 19/00* (2006.01)
*B22D 19/04* (2006.01)

(52) U.S. Cl. ..... 164/111; 164/98; 164/112

(58) Field of Classification Search ..... 164/98–112
See application file for complete search history.

(56) References Cited

U.S. PATENT DOCUMENTS 5,697,420 A 12/1997 Mori et al. ..... 164/98
2005/0217819 A1* 10/2005 Miyake et al. ..... 164/98

FOREIGN PATENT DOCUMENTS

FR 2 691 656 12/1993
JP 2002-192326 7/2002

* cited by examiner

*Primary Examiner*—Kuang Y. Lin
(74) *Attorney, Agent, or Firm*—Morgan & Finnegan, LLP

(57) ABSTRACT

A method of making a casting having a cast portion and a cap nut includes forming a hole with a stepped shape in the cap nut to have a large-diameter hole on an opening side and a threaded small-diameter hole on a bottom side, inserting a fixing member into the large-diameter hole, supporting the fixing member in a sand mold, pouring a casting material into the sand mold so that the cap nut is enveloped in the cast portion and that a first surface of the cap nut adjacent to the hole is exposed outside without being covered with a second surface of the cast portion, and removing the fixing member from the cap nut after the casting is taken out of the sand mold.

12 Claims, 8 Drawing Sheets

CASTING AND METHOD OF MAKING SUCH CASTING

BACKGROUND OF THE INVENTION

The present invention relates to a casting having a cast portion which is made of casting material and a cap nut which is enveloped in the cast portion, and also to a method of making such casting.

When a component is assembled to a large or heavy casting, a fasting bolt is often used and inserted into a cap nut which is enveloped in cast material of the casting. For enveloping the cap nut in the cast material, casting material or molten metal is poured with a bolt inserted into a threaded hole of the cap nut with the head of the bolt buried in the sand mold. In the above envelopment casting, however, the cap nut expands and contracts under the influence of heat of the casting material and cooling after casting. Additionally, part of the casting material may enter between the cap nut and the bolt thereby causing seizure therebetween. The expansion and contraction of the cap nut or the seizure between the nut and the bolt cause the threaded hole to be damaged or deformed, so that the threaded hole of the cap nut needs to be formed or threaded after casting. Thus, additional work for forming the threaded hole of the cap nut has caused a decrease in productivity and an increase in manufacturing cost.

There has been recently proposed an art for solving such problems. For example, FIG. 8 illustrates a casting method for enveloping a cap nut 50 in the casting by a full mold process. The cap nut 50 has formed therein a stepped hole 51 which includes a small-diameter threaded portion 51*a* on the bottom side and a large-diameter threaded portion 51*b* on the opening side. The cap nut 50 also has formed therearound adjacent to the large-diameter threaded portion 51*b* an annular recess or a circumferential cut 52 having a V-shaped cross-section. With this annular recess 52 as the boundary, the cap nut 50 has a nut body 50*a* on the bottom side thereof and a cylindrical extension 50*b* on the opposite side.

This casting method will now be described. The cap nut 50 is initially inserted into a support hole 54 which is formed in an evaporative pattern 53 made of, for example, expanded polystyrene. The cap nut 50 is inserted into the support hole 54 to such a depth that the annular recess 52 is positioned flush with the surface of the evaporative pattern 53. After the cap nut 50 is fixed relative to the evaporative pattern 53, a bolt 55 is screwed into the large-diameter threaded portion 51*b* of the cap nut 50. Thereafter, a sand mold 56 is made so that the mold 56 surrounds the evaporative pattern 53 and also that the bolt 55 and the cap nut 50 are partially buried in the sand mold 56. As shown in FIG. 8A, the nut body 50*a* is supported by the evaporative pattern 53, while the cylindrical extension 50*b* is buried in the sand mold 56.

The casting material is then poured into the sand mold 56. The casting material runs in the cavity of the sand mold 56 and replaces the evaporative pattern 53, so that the cap nut 50, which is fixed to the sand mold 56 by the bolt 55, is enveloped in the casting. Because the hole 51 of the cap nut 50 is then closed by the bolt 55, the casting material does not enter into the hole 51.

As shown in FIG. 8B, the resulting casting 58, which is taken out of the sand mold 56 after cooling, includes a cast portion 57 made of the casting material and the cap nut 50 enveloped in the cast portion 57, and the bolt 55 is still inserted in the cap nut 50. As shown in FIG. 8C, the bolt 55 is sheared at the annular recess 52. As a result, the bolt 55 and the cylindrical extension 50*b* of the cap nut 50 are removed, and the body 50*a* of the cap nut 50 remains in the cast portion 57. The sheared surface adjacent to the hole 51 of the nut body 50*a* is positioned flush with the surface of the cast portion 57. A component may be fixed to the casting 58 by using a fastening bolt (not shown) inserted into the small-diameter threaded portion 51*a* of the cap nut 50 which is enveloped in the cast portion 57.

Thus, the above-described casting method contributes greatly to productivity improvement and reduction of manufacturing cost, and the cap nut 50 having the annular recess 52 on the outer peripheral surface thereof is appropriate for performing the casting method which is disclosed in pages 2 through 4 and FIGS. 1 and 2 of Unexamined Japanese Patent Publication No. 2002-192326.

However, the conventional casting method or the casting does not accomplish sufficiently high productivity of castings or sufficiently low manufacturing cost yet. According to the conventional casting method, the cap nut needs to be machined previously to have the annular recess with V-shaped cross-section in the outer peripheral surface thereof, and this machining process impedes the productivity improvement and reduction of the manufacturing cost of castings.

After the casting, the bolt inserted in the cap nut is struck to shear the cap nut at the annular recess. Thus, the conventional method requires a shearing process, as well as a process for smoothening the irregularly-shaped surface which remains on the sheared surface, which further impedes higher productivity and lower manufacturing cost.

Furthermore, since the conventional cap nut requires the shearing after casting, the outer diameter of the cap nut and the inner diameter of the hole suitable for the shearing should be determined previously, which inhibits the freedom of establishing the outer diameter of the cap nut and the inner diameter of the hole into which the bolt is inserted. Therefore, there is a need for providing a casting and a casting method therefor which do not require a forming work for the hole of the cap nut, while making possible higher productivity and lower manufacturing cost of castings, and additionally higher degree of freedom for designing the cap nut.

SUMMARY OF THE INVENTION

In accordance with the present invention, a method of making a casting having a cast portion and a cap nut includes forming a hole with a stepped shape in the cap nut to have a large-diameter hole on an opening side and a threaded small-diameter hole on a bottom side, inserting a fixing member into the large-diameter hole, supporting the fixing member in a sand mold, pouring a casting material into the sand mold so that the cap nut is enveloped in the cast portion and that a first surface of the cap nut adjacent to the hole is exposed outside without being covered with a second surface of the cast portion, and removing the fixing member from the cap nut after the casting is taken out of the sand mold.

In accordance with the present invention, a casting has a cast portion and a cap nut. The cast portion is made of casting material. The cap nut is enveloped in the cast portion by casting. The cap nut has formed therein a hole and a first surface adjacent to the hole. The first surface is exposed outside without being covered with a second surface of the cast portion. The hole has a stepped shape and includes a large-diameter hole on an opening side and a threaded small-diameter hole on a bottom side. The large-diameter hole allows a fixing member to be fitted therein. The fixing member includes an inserted portion that is inserted into the large-diameter hole and a supported portion that can be supported by a sand mold during casting. The fixing member is removed from the cap nut after casting.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may be understood by reference to the following description of the presently preferred embodiments together with the accompanying drawings in which:

DETAILED DESCRIPTION OF THE PREFERRED EMBODIMENTS

A preferred embodiment of a casting and a casting method therefor according to the present invention will now be described with reference to FIGS. 1 through 3C.

Figure 1:
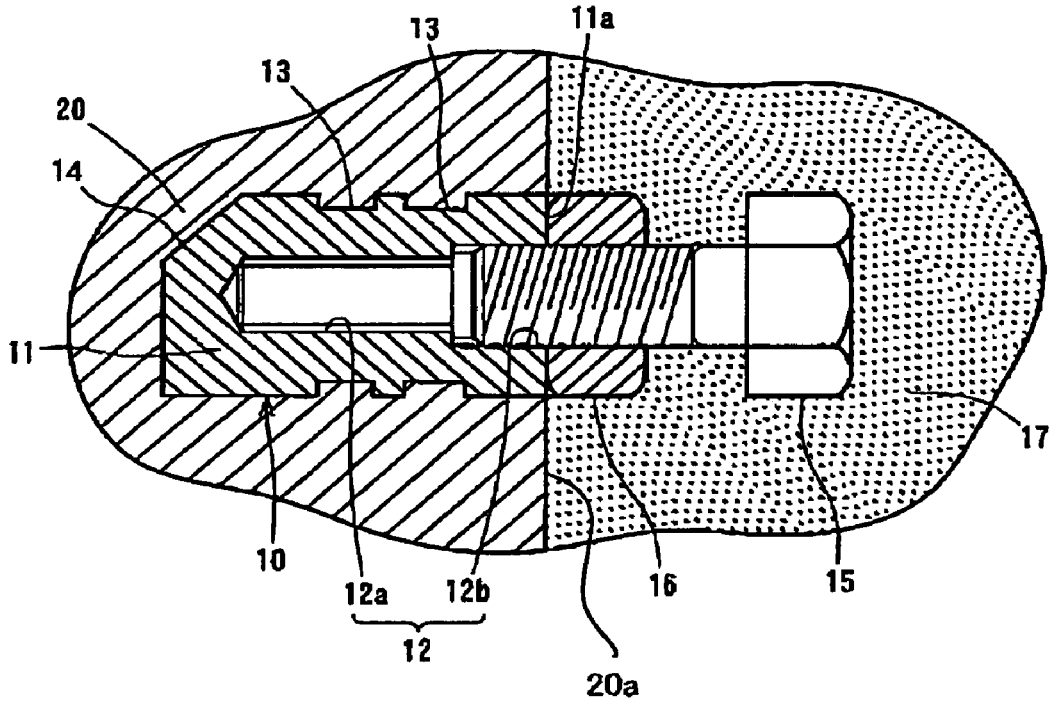
FIG. 1 is a cross-sectional view illustrating a state during casting by a casting method according to a preferred embodiment of the present invention.

FIG. 1 shows a bolt or a fixing member 15, a sand mold 17, a cap nut 10 which is supported by the sand mold 17 through the bolt 15, a locknut or a cover member 16, and a cast portion 20 made of casting material. FIGS. 2A through 2C, and 3A through 3C show respective steps of the casting method according to the preferred embodiment of the present invention.

According to the casting method of the preferred embodiment, the cap nut 10, which will be enveloped in the cast portion 20 of a casting 21, the bolt 15, and the locknut 16 are previously prepared.

The cap nut 10 will now be described. As shown in FIG. 1, the cap nut 10 is enveloped in the cast portion 20 of the casting 21, which will be described later, and a cap nut body 11 has formed therein a hole 12. The hole 12 is formed with a stepped shape, having a small-diameter hole 12*a* on the bottom side and a large-diameter hole 12*b* on the opening side. In the preferred embodiment, the holes 12*a* and 12*b* each have formed therein an internal thread. A fastening bolt (not shown) for fitting a component to a finished casting 21 may be inserted into the small-diameter hole 12*a*, and the bolt 15, which will be described later, may be screwed into the large-diameter hole 12*b*.

The cap nut body 11 has formed in the outer peripheral surface thereof engaging grooves 13 which extend parallel to each other, and the engaging grooves 13 function as retaining means for preventing the cap nut 10 from falling off from the cast portion 20 of the casting 21. The cap nut body 11 is formed at the bottom thereof with a planar inclined portion 14, which functions as rotation prevention mean for preventing the cap nut 10 from rotating relative to the cast portion 20 of the casting 21.

Known bolt and nut are used for the bolt 15 and the locknut 16, respectively. The bolt 15 has an external thread for the large-diameter hole 12*b* of the cap nut 10, and the locknut 16 has an internal thread for the external thread of the bolt 15. The cap nut 10, the bolt 15 and the locknut 16 are all made of metal in the preferred embodiment.

Figure 2A:
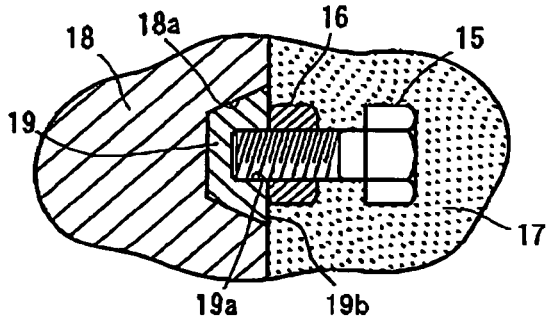
FIGS. 2A through 2C are explanatory views illustrating respective steps of procedure of the casting method before the pouring process in the casting method according to the preferred embodiment of the present invention.

The casting method according to the preferred embodiment will now be described with reference to FIGS. 2A through 3C. As shown in FIG. 2A, the sand mold 17 is formed. A mother die 18 is used for forming the sand mold 17 and has formed therein a recess 18*a* for receiving therein a bolt fitting 19. The bolt fitting 19 has formed therein a threaded hole 19*a* for receiving therein the bolt 15. Thus, before forming the sand mold 17, the locknut 16 is fitted to the bolt 15 such that the distal end of the external thread of the bolt 15 protrudes out of the locknut 16.

Subsequently, the bolt fitting 19 is fitted over the protruded external thread of the bolt 15 in such a way that the surface 19*b* (which corresponds to a third surface of the present invention) of the bolt fitting 19 is in close contact with the back surface of the locknut 16. The bolt fitting 19 with the bolt 15 and the locknut 16 is mounted on the mother die 18. According to the preferred embodiment, it is so arranged that the surface of the mother die 18 is flush with the surface 19*b* of the bolt fitting 19. After the bolt fitting 19 is mounted on the mother die 18, the mother die 18 is filled with molding sand for the sand mold 18. A portion of the bolt 15 and the locknut 16, which are connected with the bolt fitting 19, will be covered with the molding sand and then buried in the sand mold 17.

In the preferred embodiment, the molding sand contains furan-based resin as hardener, so that the sand mold 17 made of such molding sand has strong shape retention. Accordingly, the sand mold 17 retains its shape without collapsing when it is removed from the mother die 18 and the bolt 15 and the locknut 16 are supported securely by the sand mold 17. A portion where the bolt 15 is supported by the sand mold 17 is a supported portion of the bolt 15 in the preferred embodiment.

Figure 2B:
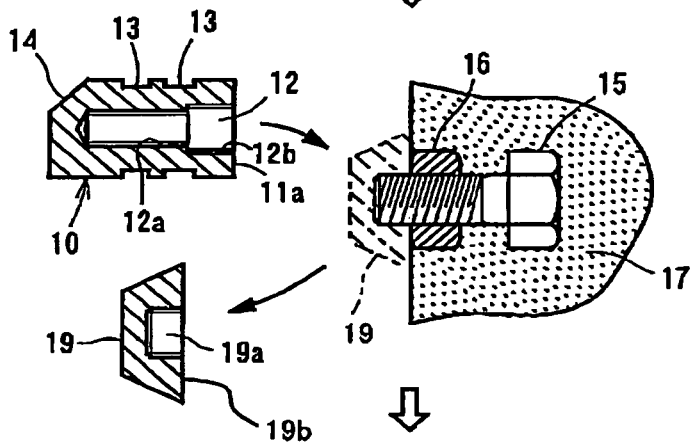
Figure 2C:
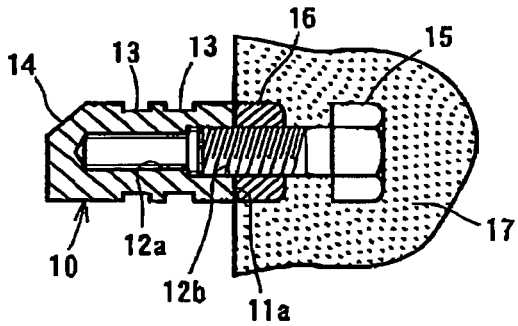

The bolt fitting 19 is removed from the bolt 15, as shown in FIG. 2B, and the cap nut 10 is fitted to part of the external thread of the bolt 15 which protrudes from the surface of the sand mold 17, as shown in FIG. 2C. The part of the external thread of the bolt 15 (or an inserted portion of the bolt 15) protruding from the surface of the sand mold 17 is inserted into the large-diameter hole 12*b* in the hole 12 of the cap nut 10, and a surface 11*a* of the cap nut body 11 adjacent to the hole 12 (which surface 11*a* corresponds to a first surface of the present invention and will be referred to as "body top surface 11*a*", hereinafter) is set in close contact with the back surface of the locknut 16, as shown in FIG. 2B. The cap nut 10, which is screwed on the bolt 15, is supported by the sand mold 17 through the bolt 15. By setting the cap nut body 11 with the body top surface 11*a* set in close contact with the back surface of the locknut 16, the cap nut 10 is securely held relative to the bolt 15 even if the cap nut 10 is not screwed deep on the bolt 15.

Casting material or molten metal is subsequently poured into the sand mold 17. Cast iron is employed as the casting material in the preferred embodiment. However, metals other than the iron-based metals (for example, cast iron), such as aluminum-based metals, copper-based metals are usable in the preferred embodiment.

Figure 3A:
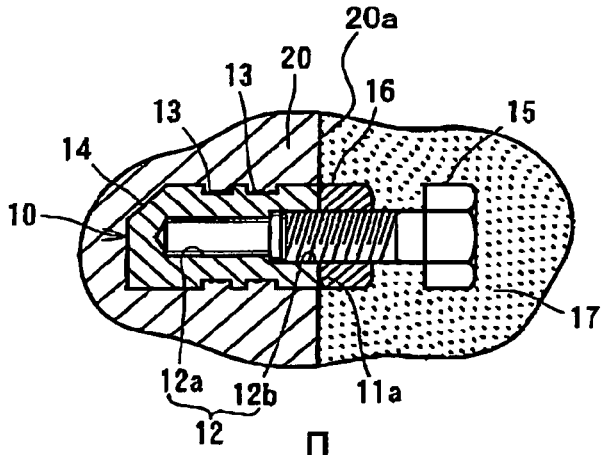
FIGS. 3A through 3C are explanatory views illustrating respective steps of procedure of the casting method after the pouring process until finishing a cast product in the casting method according to the preferred embodiment of the present invention.

As shown in FIG. 3A, the cap nut 10 is enveloped in the casting material with all surfaces of the cap nut 10 except its body top surface 11*a* surrounded by the casting material. When the casting material is poured, the cap nut 10 expands due to the heat of the casting material, and the internal thread of the large-diameter hole 12*b* of the hole 12 of the cap nut 10, in which the bolt 15 is screwed, slightly deforms. On the other hand, the small-diameter hole 12*a* of the hole 12 of the cap nut 10, in which no part of the bolt 15 is inserted, does not substantially deform.

The body top surface 11*a* and the back surface of the locknut 16 are in close contact with each other, that is, the body top surface 11*a* is covered with the back surface of the locknut 16, so that the molten casting material neither enters therebetween, nor reaches the hole 12 of the cap nut 10.

Figure 3B:
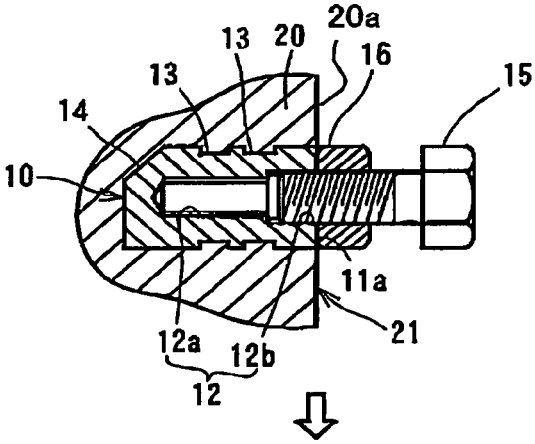

Pouring a predetermined amount of casting material into the sand mold, allowing the poured casting material to be cooled, removing the sand mold 17 after the cooling, the casting 21 is then formed with the cap nut 10 enveloped therein, as shown in FIG. 3B. The cap nut 10 contracts during the cooling, so that the internal thread of the large-diameter hole 12*b*, which has deformed due to the thermal expansion, further deforms to be damaged. The resulting casting 21 has the cast portion 20 which is formed of the cooled casting material and the cap nut 10 which is enveloped in the cast portion 20 and receives therein the bolt 15.

Figure 3C:
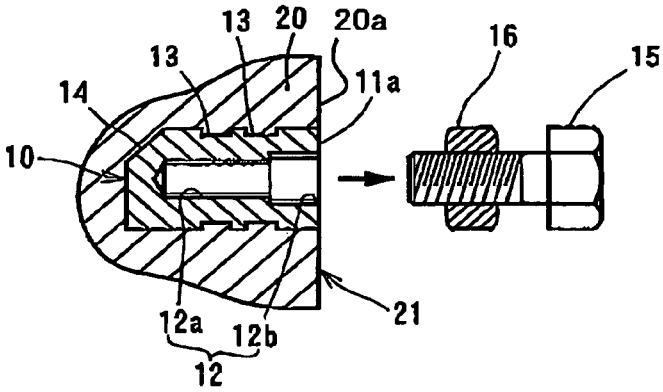

As shown in FIG. 3C, the casting 21 is finished by removing the bolt 15 together with the locknut 16 from the cap nut 10. The removed bolt 15 may be reused several times as the fixing member. The locknut 16 may also be reused as the cover member.

With the bolt 15 removed from the cap nut 10, the body top surface 11*a* and the surface 20*a* (which corresponds to a second surface of the present invention) of the cast portion 20 are substantially flush with each other, and the body top surface 11*a*, with which the back surface of the locknut 16 had been contact as shown in FIG. 3A, is flat and smooth and also is exposed outside without being covered with the surface 20*a* of the cast portion 20. The cap nut 10, which is enveloped in the cast portion 20, does not fall off from the cast portion 20 due to the engagement between the engaging grooves 13 of the cap nut body 11 and the cast portion 20. The provision of the inclined portion 14 at the bottom of the cap nut body 11 which engages with the cast portion 20 prevents the cap nut 10 from rotating relative to the cast portion 20. A fastening bolt (not shown) may be screwed into the smaller-diameter hole 12*a* of the cap nut 10 for fixing a component to the casting 21.

According to the preferred embodiment, the following advantageous effects are obtained.

(1) According to the preferred embodiment, seizure between the cap nut 10 and the bolt 15 is prevented, and the casting 21 that permits a component to be fixed thereto is formed merely by removing the bolt or the fixing member 15 from the cap nut 10. If seizure occurs between the cap nut 10 and the bolt 15 and, therefore, the bolt 15 needs to be removed forcibly from the cap nut 10, only the large-diameter hole 12*b* of the hole 12 of the cap nut 10 is damaged and the small-diameter hole 12*a* used for fitting the component remains intact.

Figure 8A:
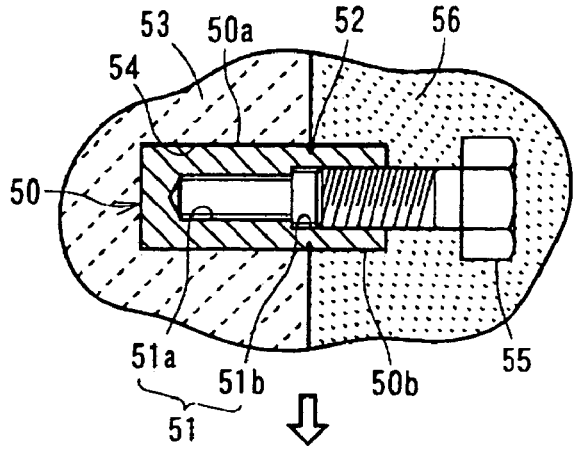
FIG. 8A (PRIOR ART)
FIGS. 8A through 8C are explanatory views illustrating respective steps of procedure of the casting method according to a prior art.
Figure 8B:
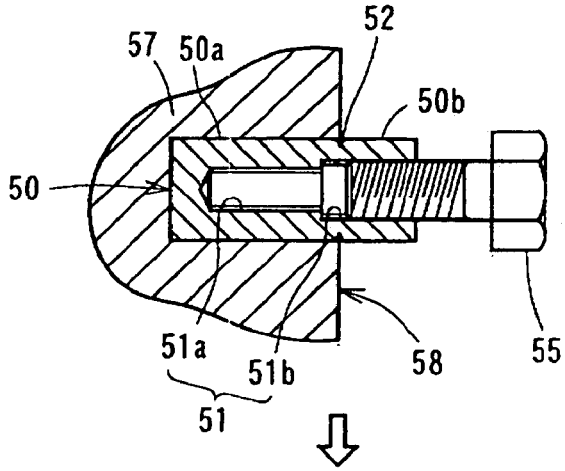
FIG. 8B (PRIOR ART)
Figure 8C:
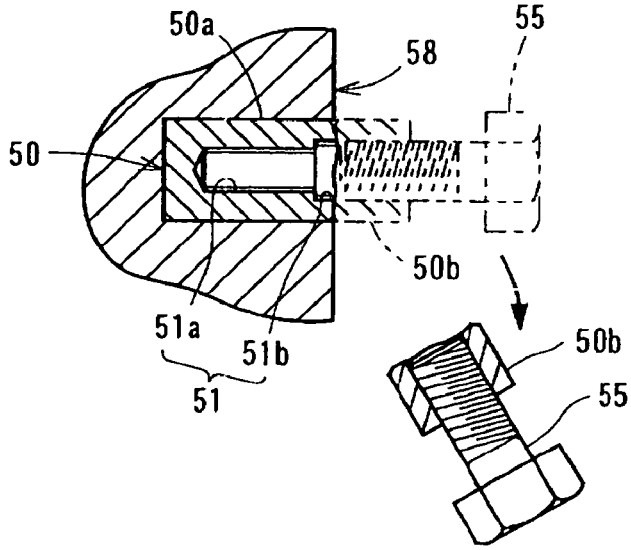
FIG. 8C (PRIOR ART)

(2) Tho casting method according to the preferred embodiment does not require a recess or a circumferential cut 52 as referred to in FIG.8 and, therefore, troublesome and time-consuming work for shearing the cap nut and then finishing the sheared surface of the cap nut does not need to be performed. Thus, the production cost of the casting is reduced.

(3) The casting material is poured into the mold with the back surface of the locknut or the cover member 16 set in close contact with the body top surface 11*a*, so that the casting material is not allowed to enter and reach the body top surface 11*a*, thereby making it possible to use the body top surface 11*a* as a seat surface for fitting a component.

(4) Since no shearing work for removing a part of the cap nut is performed after casting, for example, the thickness of the cap nut at the large-diameter hole 12*b* may be determined without consideration for shearing, so that the diameter of the hole 12 of the cap nut 10 may be determined with less restriction according to any given requirements. For example, when a heavy component is to be fitted to the casting 21, a fastening bolt with a relatively large axial tension may be employed.

(5) With the locknut 16 screwed on the bolt 15, the depth of insertion of the bolt 15 through the cap nut 10 may be adjusted in the increment of the thread pitch of the bolt. With the thermal expansion and contraction of the cap nut 10 and workability of removal of the bolt 15 after casting taken into consideration, the bolt 15 may be inserted through the cap nut 10 as desired.

(6) The back surface of the locknut 16 is set in close contact with the body top surface 11*a*, so that the bolt 15 is held securely in the cap nut 10 without being inclined relative to the cap nut 10.

Figure 4:
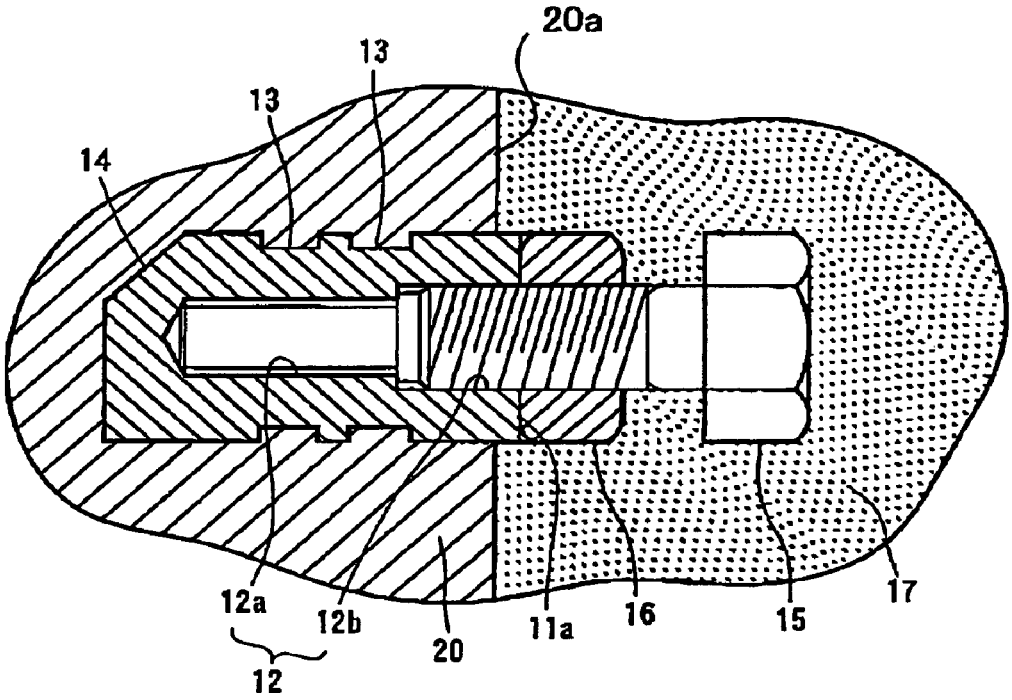
FIG. 4 is a cross-sectional view illustrating a state where the top surface of the cap nut is protruded from the surface of the cast portion during casting according to an alternative embodiment of the present invention.
Figure 5:
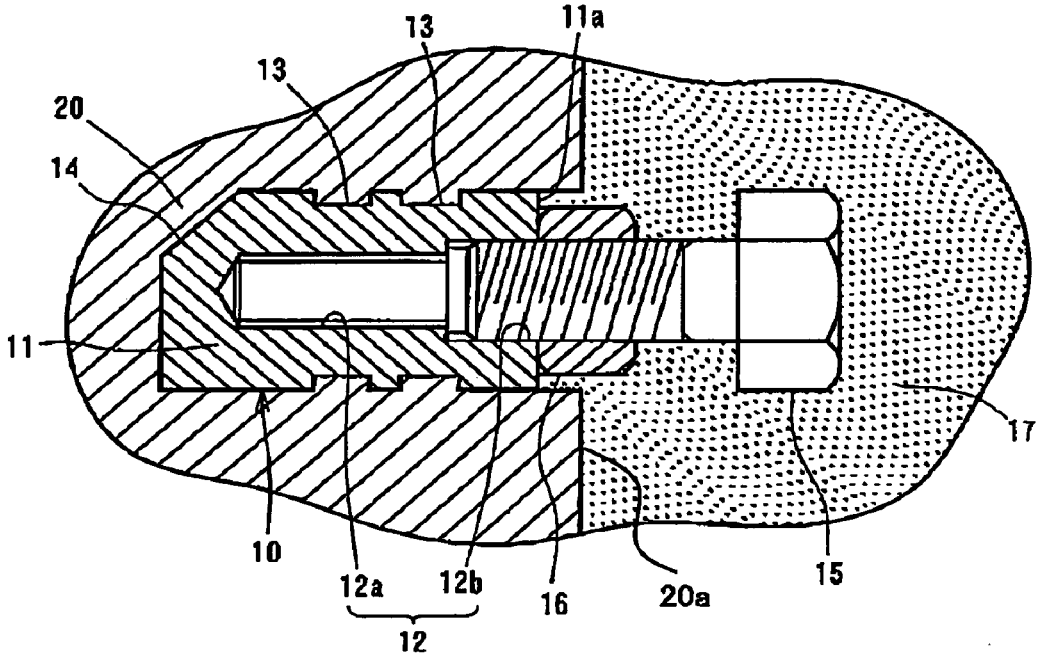
FIG. 5 is a cross-sectional view illustrating a state where the top surface of the cap nut is recessed from the surface of the cast portion during casting according to an alterative embodiment of the present invention.

In the preferred embodiment, the exposed body top surface 11*a* and the exposed surface 20*a* of the cast portion 20 are flush with each other. It may be so arranged, however, that the body top surface 11*a* is protruded from the surface 20*a* of the cast portion 20, as shown in FIG 4. Furthermore, as shown in FIG. 5, the body top surface 1 la may be provided so as to be recessed from the surface 20*a* of the cast portion 20. In this case, it is preferable that the locknut 16 should be fitted to the bolt 15 in such a way that the locknut 16 is set in close contact with the body top surface 11*a* so that the casting material does not enter to reach the external thread of the bolt 15. By arranging the exposed body top surface 11*a* of the cap nut 10 in a plane different from that of the exposed surface 20*a* of the cast portion 20 as shown in FIGS. 4 and 5, the casting 21 can meet a wider range of requirements of components which are to be fitted to the casting 21.

The present invention is not limited to the embodiments described above, but may be modified into the following alterative embodiments.

Figure 6:
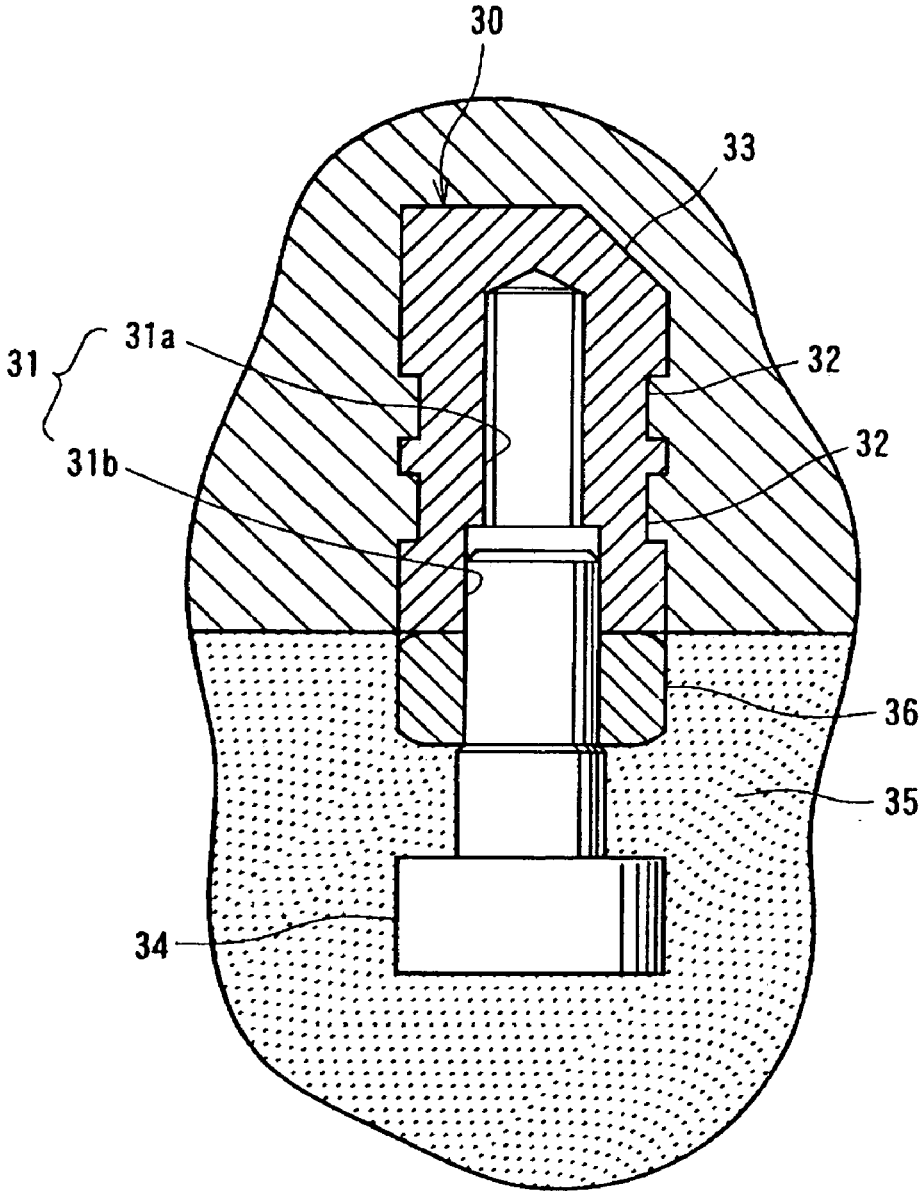
FIG. 6 is a cross-sectional view illustrating a state where the cap nut is fitted on a pin with a head during casting according to an alternative embodiment of the present invention.

In the preferred embodiment, the large-diameter hole of the cap nut has formed therein an internal thread for receiving therein the bolt or the fixing member. In an alternative embodiment, should the cap nut be held by the fixing member supported by the sand mold by any suitable means, the large-diameter hole does not need to have an internal thread, and the bolt or the fixing member will be useless. In an example shown in FIG. 6, in which a pin 34 having a head and a stepped shape protrudes upward from the sand mold 35 that has a horizontal surface and a large-diameter hole 31*b* in a hole 31 of a cap nut 30 is fitted to the pin 34, the cap nut 30 which is fitted to the pin 34 by its own weight will not fall off from the pin 34. In this case, only the small-diameter hole 31*a* is threaded, and the cap nut 30 has engaging grooves 32 and an inclined portion 33. A ring or a cover member 36 which is not threaded is installed in the middle portion of the pin 34.

Figure 7:
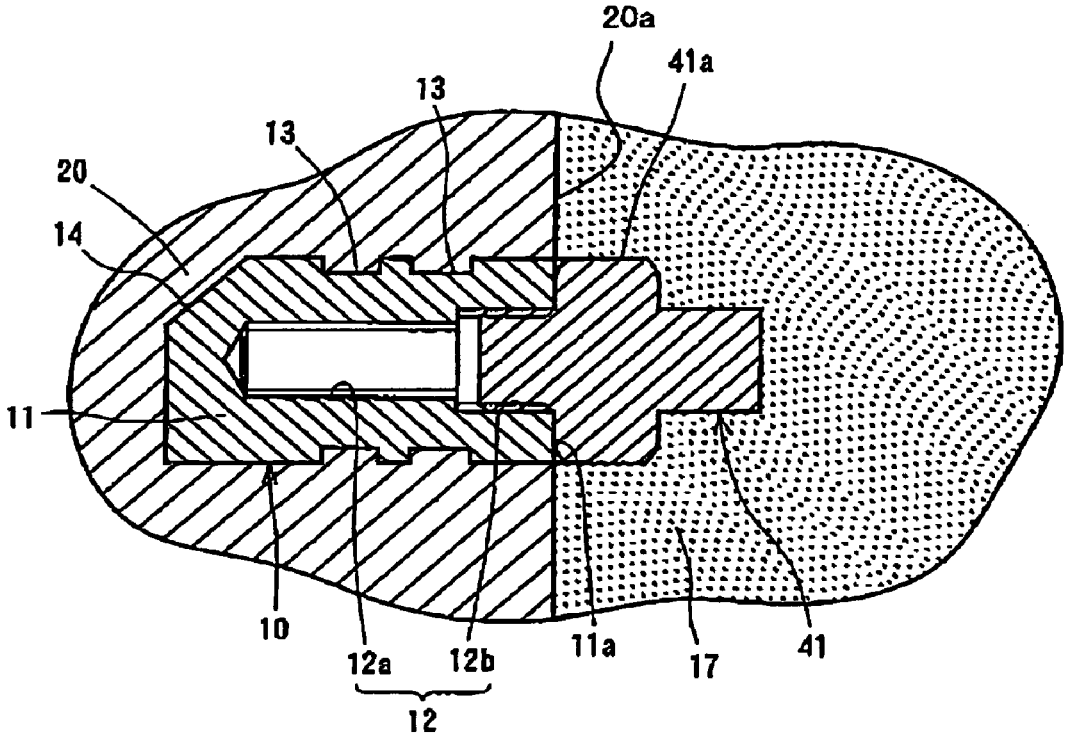
FIG. 7 is a cross-sectional view illustrating a state where a fixing member has formed therein a covered portion according to an alternative embodiment of the present invention.

In the preferred embodiment, the bolt or the fixing member 15 and the locknut or the cover member 16 are separately prepared. In an alternative embodiment, it may be so arranged that the cover member and the fixing member are formed integrally as a single part, as shown in FIG. 7. To be more specific, the bolt 41 as the fixing member is formed with a covered portion 41*a* as the cover member. Using such bolt 41 for the cap nut 10, the number of components required for casting is reduced, resulting in shortened setting-up time for the casting.

In the preferred embodiment, the locknut or the cover member is used for the bolt or the fixing member to which the cap nut is fitted. In an alternative embodiment, if the cap nut neither moves nor incline relative to the bolt, the locknut or the cover member may be omitted. In this case of an alternative embodiment, time for casting operation and the number of components required for the casting are reduced, thereby making possible further cost reduction of the castings.

In the preferred embodiment, the cap nut has formed on the outer peripheral surface thereof the parallel engaging grooves as the retaining means. The grooves may be dispensed with, however, when a bolt to be inserted into the small-diameter hole of the cap nut for fitting a component to the casting has a small fastening force. In this alternative embodiment, machining of the cap nut for providing the grooves may be omitted, thus cost of the casting being further reduced.

In the preferred embodiment, the cap nut has formed on the outer peripheral surface thereof the parallel engaging grooves as the retaining means, but the retaining means is not limited to the engaging grooves. In an alternative embodiment, any retaining means may be used as the means is capable of preventing the cap nut from falling off from the cast portion of the casting. For example, a protrusion provided on the outer peripheral surface of the cap nut may be used as the retaining means.

In the preferred embodiment, the cap nut separately has formed therein the engaging grooves or the retaining means on the outer peripheral surface thereof and an inclined surface or the rotation prevention means on the bottom thereof. In an alternative embodiment, the cap nut is formed to have a protrusion or a recess that doubles as the retaining means and the rotation prevention means.

Though the description of the preferred embodiment has not referred to application of the castings the present invention is applicable to manufacturing of a counterweight for an industrial vehicle, a large-size press die used for stamping vehicle parts.

As apparent from the foregoing, a casting having a cap nut enveloped therein and a method of making such casting according to the present invention are advantageously applicable to the manufacture of large-size or heavy parts which are difficult to handle and, therefore, have formed therein many cap nuts as fitting members.

Therefore, the present examples and embodiments are to be considered as illustrative and not restrictive, and the invention is not to be limited to the details given herein but may be modified within the scope of the appended claims.

What is claimed is:

1. A method of making a casting having a cast portion and a cap nut, comprising the steps of:

forming a hole with a stepped shape in the cap nut to have a large-diameter hole on an opening side and a threaded small-diameter hole on a bottom side;

inserting a fixing member into the large-diameter hole;

covering a first surface of the cap nut adjacent to the hole with a cover member;

supporting the fixing member in a sand mold;

pouring a casting material into the sand mold so that the cap nut is enveloped in the cast portion and that a first surface of the cap nut adjacent to the hole is exposed outside without being covered with a second surface of the cast portion; and removing the fixing member from the cap nut after the casting is taken out of the sand mold.

2. The method according to claim 1, wherein the cover member is fitted to the fixing member.

3. The method according to claim 1, wherein the fixing member is a bolt,the cover member being a locknut.

4. The method according to claim 3, further comprising the step of:

forming the sand mold with a mother die for mounting thereon a bolt fitting.

5. The method according to claim 4, further comprising the step of:

fitting the locknut to the bolt, wherein the inserting step includes fitting the bolt together with the locknut to the bolt fitting.

6. The method according to claim 5, wherein the inserting step further includes the step of setting a third surface of the bolt fitting in close contact with a back surface of the locknut.

7. The method according to claim 5, wherein the supporting step includes the step of filling the mother die with molding sand.

8. The method according to claim 3, wherein the forming step includes the step of threading an internal thread in the large-diameter hole for screwing thereinto the bolt.

9. The method according to claim 1, further comprising the step of:

forming a retaining means in an outer peripheral surface of the cap nut for preventing the cap nut from falling off from the cast portion.

10. The method according to claim 9, wherein the retaining means is an engaging groove.

11. The method according to claim 1, further comprising the step of:

forming a rotation prevention means on a bottom of the cap nut for preventing the cap nut from rotating relative to the cast portion.

12. The method according to claim 11, wherein the rotation prevention means is an inclined portion.

* * * * *

UNITED STATES PATENT AND TRADEMARK OFFICE

CERTIFICATE OF CORRECTION

PATENT NO. : 7,086,448 B2
APPLICATION NO. : 11/064652
DATED : August 8, 2006
INVENTOR(S) : Takahito Miyake et al.

It is certified that error appears in the above-identified patent and that said Letters Patent is hereby corrected as shown below:

In the Specification

Col. 3, ln 36, please delete "an alterative" and insert therefore -- an alternative--;
col. 3, ln. 61, please delete "respective steps of the casting" and insert therefore --respective steps of procedure of the casting--:
col. 4, ln. 20, please delete "mean for preventing" and insert therefore --means for preventing--;
col. 6, ln 50, please delete "top surface 1 1a" and insert therefore --top surface 11a--.

Signed and Sealed this

Tenth Day of April, 2007

JON W. DUDAS
*Director of the United States Patent and Trademark Office*